United States Patent [19]

Kubo et al.

[11] 4,311,750

[45] Jan. 19, 1982

[54] THERMO-SENSITIVE MULTI-COLOR RECORDING MATERIAL AND PROCESS FOR PREPARATION THEREOF

[75] Inventors: Keishi Kubo, Yokohama; Tetsuo Tanaka, Mishima, both of Japan

[73] Assignee: Ricoh Company Limited, Tokyo, Japan

[21] Appl. No.: 100,067

[22] Filed: Dec. 4, 1979

[30] Foreign Application Priority Data

Dec. 14, 1978 [JP] Japan ..... 53-153695

[51] Int. Cl.[3] ..... B41M 5/18

[52] U.S. Cl. ..... 428/212; 282/27.5; 427/150; 427/151; 427/152; 428/488; 428/537; 428/913; 430/348

[58] Field of Search ..... 282/27.5; 427/150, 151, 427/152; 428/212, 484, 485, 486, 488, 537, 913, 914, 307, 323, 411; 430/348

[56] References Cited

U.S. PATENT DOCUMENTS

| | | | |
|---|---|---|---|
| 3,843,384 | 10/1974 | Adachi et al. | 428/199 |
| 3,895,173 | 7/1975 | Adachi | 428/537 |
| 3,906,123 | 9/1975 | Vincent et al. | 428/411 |
| 4,114,926 | 9/1978 | Habib et al. | 282/27.5 |

*Primary Examiner*—Bruce H. Hess

*Attorney, Agent, or Firm*—Blanchard, Flynn, Thiel, Boutell & Tanis

[57] ABSTRACT

A multi-color thermo-sensitive recording material comprises two thermo-sensitive coloring layers capable of forming different colors respectively at different temperatures, which are formed one over the other on a support member, and a discoloring layer comprising a cross-linking type resin, which is disposed between the two thermo-sensitive coloring layers, and which is cross-linked in the course of the coating of the thermo-sensitive layers, without being dissolved into any of the two thermo-sensitive coloring layers.

9 Claims, No Drawings

THERMO-SENSITIVE MULTI-COLOR RECORDING MATERIAL AND PROCESS FOR PREPARATION THEREOF

BACKGROUND OF THE INVENTION

The present invention relates to a multi-color thermo-sensitive recording material and a process for preparation thereof.

The thermo-sensitive recording material is a recording material comprising a support member, for example, paper, and a thermo-sensitive layer capable of forming a color upon application of heat, which layer is formed on the support member. For the application of heat, for example, a thermal printer with a thermal head is employed. The multi-color thermo-sensitive recording material comprises a support member and at least two thermo-sensitive layers formed on the support member. Each of the thermo-sensitive layers is capable of forming a different color at a different temperature. Usually, a lower layer is capable of forming a color at a high temperature, while an upper layer is capable of forming another color at a low temperature.

When heat is applied to such a multi-color thermo-sensitive recording material at two different temperatures, images are formed in different colors. When heat is applied to the multi-color thermo-sensitive recording material at a comparatively low temperature, a blue color, for example, is formed, while when the recording material is heated at a comparatively high temperature, a red color, for example, is formed.

When such colors are formed, using the multi-color thermo-sensitive recording material, if the recording material is heated at a low temperature, the color to be formed at the low temperature is normally formed. However, when the recording material is heated at a high temperature, two colors, that is, the two colors to be formed at a low temperature and a high temperature, respectively are both formed and mixed. In order to eliminate such a shortcoming, it has been proposed to use several decoloring agents capable of forming the respective colors separately at a low temperature and a high temperature. As the decoloring agents, solid alcohols, polyether, polyethylene glycol, and quanidine derivatives are employed in such a manner that any of these decoloring agents is inserted between the thermo-sensitive layers.

The multi-color thermo-sensitive recording material is prepared by forming a high temperature thermo-sensitive coloring layer, a decoloring layer and then a low temperature thermo-sensitive coloring layer one over the other on a support member. The inventors of the present invention produced the multi-color thermo-sensitive recording materials of this type by a continuous coating machine after the investigation of an experimental scale and were confronted with a problem that, in the initial step of coating the low temperature thermo-sensitive coloring layer, the thermo-sensitive recording materials were produced with the desired properties, but as the coating process proceeded, the coloring density of the low temperature thermo-sensitive coloring layer was gradually lowered so that the properties of the multi-color thermo-sensitive recording materials produced became nonuniform. In the course of the investigation of this problem, the inventors discovered that part of the surface of the decoloring layer was dissolved into the low temperature thermo-sensitive coloring layer during the coating thereof and the materials of the dissolved decoloring layer built up in a container of the low temperature thermo-sensitive coloring layer materials, so that when the multi-color thermo-sensitive recording material is produced, using the low temperature thermo-sensitive coloring layer liquid contaminated with the decoloring layer materials, the products produced in the initial coating process and those produced thereafter differ in the coloring density.

SUMMARY OF THE INVENTION

It is therefore an object of the present invention to prepare a multi-color thermo-sensitive recording material comprising two thermo-sensitive coloring layers capable of forming different colors respectively at different temperatures, which layers are formed one over the other on a support member, and a decoloring layer comprising a cross-linking type resin, which is disposed between the two thermo-sensitive coloring layers and which is cross-linked without being dissolved into either of the two thermo-sensitive coloring layers in the course of the coating of the thermo-sensitive layers.

In the present invention, at least an upper thermo-sensitive coloring layer comprises a colorless or light-colored leuco dye and a phenolic material or acidic material.

In one embodiment of a multi-color thermo-sensitive recording material according to the present invention, in the decoloring layer there is employed a self cross linking type water soluble resin, such as initial condensed compounds of aminoplasts, methylolurethanated polyvinyl alcohol, polyamides having epoxy groups or methylol groups at the ends of the molecules or at the side chains, and hydrocarbon resins having methylol groups at the ends of the molecules or at the side chains.

In another embodiment of a multi-color thermo-sensitive recording material according to the present invention, the decoloring layer comprises an organic polymeric binder material with addition of a cross-linking agent thereto.

The examples of the polymeric binder material for use in this embodiment are casein, starch, denaturated starch, polyvinyl alcohol, polyvinyl acetal, polyacrylamide, polyvinyl pyrrolidone, partially saponified vinyl acetate, sodium alginate, polyacrylic acid, polyacrylate, partially esterified polyacrylic acid, carboxymethyl cellulose, methoxy cellulose, hydroxyethyl cellulose, mannan and tragacanth gum.

Furthermore, the examples of the cross-linking agent for this embodiment are initial condensed compounds of aminoplasts including melamine resin, urea resin, thiourea resin, anilineformaldehyde resin and cyanamide-formaldehyde resin; N-methylolacrylamide resin; polyamide resin having epoxy groups or methylol groups having at the ends of the molecules or at the side chains thereof; hydrocarbon resin having methylol groups including methylolurethanated polyvinyl alcohol; and glyoxal.

According to the present invention, since the decoloring layer is made insoluble by the cross-linking of the components of the decoloring layer in the course of the coating thereof, the color mixing of the two thermo-sensitive coloring layers is prevented so that the multi-color thermo-sensitive recording material can be produced with uniform quality.

DETAILED DESCRIPTION OF THE PREFERRED EMBODIMENTS

A preferred embodiment of a multi-color thermo-sensitive recording material comprises two thermo-sensitive coloring layers capable of forming different colors respectively at different temperatures, which are formed one over the other on a support member, and a decoloring layer disposed between the two thermo-sensitive coloring layers. Particularly, in this embodiment, at least the upper thermo-sensitive coloring layer comprises a colorless or light-colored leuco dye and a phenolic material or acidic material and the decoloring layer consists essentially of a decoloring agent capable of decoloring color-forming materials of the upper thermo-sensitive coloring layer, and a binder agent which is a water soluble resin of a self cross-linking type.

The self cross-linking type water soluble resins are organic polymeric compounds having two or more atoms or atomic groups that can react with each other in one polymeric molecule and become insoluble in water when reacted with each other. As the self cross-linking type water soluble resins, the following can be employed:

initial condensed compounds of aminoplasts (amino resin), methylolurethanated polyvinyl alcohol, polyamides having epoxy groups or methylol groups at the ends of the molecules or at the side chains, and hydrocarbon resins having methylol groups at the ends of the molecules or at the side chains.

As the initial condensed compounds of aminoplasts, the following can be employed: formaldehyde resins of dimethylolmelamine, dimethyltrimethylolmelamine, trimethylolmelamine, tetramethylolmelamine, tetramethylpentamethylolmelamine, tetramethylhexamethylolmelamine, pentamethylpentamethylolmelamine, pentamethylhexamethylolmelamine, and the other alkylated melamines; ureaformaldehyde resin, anilineformaldehyde resin; thiourea formaldehyde resin; and cyanamide formaldehyde resin.

Polyamides having epoxy groups at the ends of the molecules are, for example, compounds represented by the following general formula:

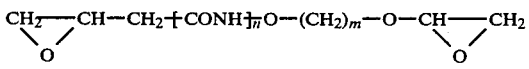

Hydrocarbon resins having methylol groups at the side chains are, for example, compounds represented by the following general formula:

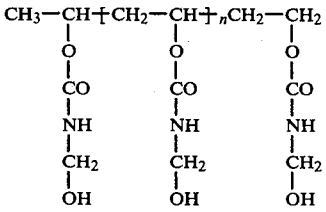

As the additives for promoting the cross-linking in the discoloring layer, compounds, such as ammonium nitrate, sodium nitrate, ammonium chloride and ammonium phosphate can be added to the decoloring layer.

The decoloring agents for use in the present invention are capable of decoloring a color-forming material comprising a leuco dye and a phenolic compound or acidic compound. The examples of the decoloring agents are as follows:

(a) Oxidized alkylene addition compounds of bisphenols represented by the following general formula:

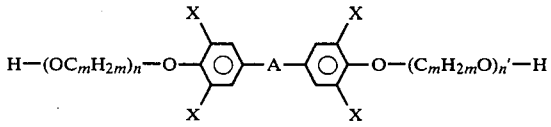

wherein A represents methylene or alkylidene, and X represents hydrogen or a halogen, and $m=2\sim4$ and n and $n'=1\sim5$.

(b) Methylolamide and bisamide whose respective melting point is 110° C. or higher (c) Long chain aliphatic 1, 2-glycol with 12 to 32 carbon atoms (d) Ethylene oxide addition compound of terephthalic acid (e) Solid alcohols, such as stearyl alcohol, tripropylcarbinol, polyethylene glycol, polypropylene glycol, 1,8-octanediol, dimethylpentaglycerin, and 1,2,3,4-tetraoxybutane (Japanese Patent Publication No. 50-17865)

(f) Polyoxydecamethylene, polyoxymethylene, polyethylene oxide, a polymer of trimethylene oxide, a polymer of 1,3-dioxolan, polyethers or derivatives of polyethylene glycol, such as polyoxyethylenealkylamine, sorbitan monostearate, polyoxyethylene oleyl ether, polyethylene glycol monostearate, polyoxyethylene alkylamide, oxyethylene alkylamine (Japanese Patent Publication No. 50-17867)

(g) Acetamide, stearamide, phthalonitrile, m-nitroaniline, β-naphtylamine (Japanese Patent Publication No. 51-19991)

(h) Guanidine derivatives, such as 1,3-dicyclohexyl-2-phenylguanidine, 1,3-dicyclohexyl-2-naphthylguanidine, 2,3-dicyclohexyl-1-phenylguanidine, 1,2,3-triphenylguanidine (Japanese Patent Publication No. 51-29024)

(i) Amines or tertiary ammonium salts, such as hexadecylamine, tribenzylamine, N,N,N',N'-tetrabenzylethylenediamine, tricyclohexylamine, dioctadecylamine, 2-aminobenzoxazole, dodecyltrimethylammonium chloride and hexadecyltrimethylammonium chloride (Japanese Laid-open Patent Application No. 50-18048)

The above-mentioned compounds can be employed as the decoloring agents.

In the present invention, by use of the self cross-linking resins as the binder agent in the decoloring layer, the water proofness of the decoloring layer is improved to some extent, so that the decoloring layer is prevented from being dissolved into the low temperature thermo-sensitive coloring layer to be applied on the decoloring layer, whereby the multi-color thermo-sensitive recording materials are produced with a uniform quality.

The above-mentioned decoloring agents act so as to decolor the color-forming materials comprising a leuco dye and a phenolic material or acidic material. Therefore, a coloring material comprising a leuco dye and a phenolic material or acidic material has to be contained in the low temperature thermo-sensitive coloring layer. On the other hand, since it is unnecessary to decolor the high temperature thermo-sensitive coloring layer, conventional coloring materials can be employed in the high temperature thermo-sensitive coloring layer.

When a leuco dye and a phenolic material or acidic material are employed in the high temperature thermo-sensitive coloring layer, as in the case of the low temperature thermo-sensitive coloring layer, the leuco dye and the phenolic material or acidic material should be chosen, taking into consideration the color tone and the coloring temperature of the high temperature thermo-sensitive coloring layer. Many colorless or light-colored leuco dyes have been proposed for the present invention and some of the examples are as follows:

(1) Leuco bases of triphenylmethane dyes which are represented by the following general formula:

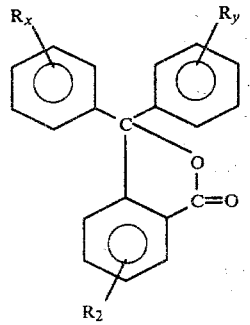

wherein Rx, Ry and Rz are individually hydrogen, a hydroxyl group, a halogen, an alkyl group, a nitro group, an amino group, a dialkylamino group, a monoalkyl group, and an aryl group.

The specific examples of the above-mentioned compounds are as follows:

3,3-Bis(p-dimethylaminophenyl)-phthalide,
3,3-Bis(p-dimethylaminophenyl)-6-dimethylamonphthalide (or Crystal Violet Lactone),
3,3-Bis(p-dimethylaminophenyl)-6-diethylamiophthalide,
3,3-Bis(p-dimethylaminophenyl)-6-chlorophthalide,
3,3-Bis(p-dibutylaminophenyl)-phthalide.

(2) Leuco bases of fluoran dyes which are represented by the following general formula:

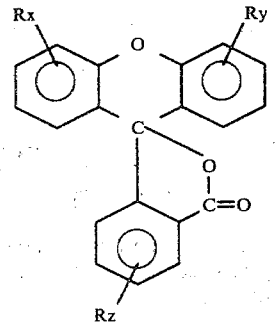

wherein Rx, Ry and Rz are individually hydrogen, a hydroxyl group, a halogen, an alkyl group, a nitro group, an amino group, a dialkylamino group, a monoalkyl group, and an aryl group.

The specific examples of the above-mentioned compounds are as follows:

3-cyclohexylamino-6-chlorofluoran,
3-(N,N-diethylamino)-5-methyl-7-(N,N-dibenzylamino) fluoran,
3-dimethylamino-5,7-dimethylfluoran,
3-diethylamino-7-methylfluoran,
3-diethylamino-7,8-benzfluoran,
3-diethylamino-6-methyl-7-chlorofluoran,
3-pyrrolidino-6-methyl-7-anilinofluoran,
2-[N-(3'-trifluoromethylphenyl)amino]-6-diethylamino-fluoran,
2-[3,6-bis(diethylamino)-9-(o-chloroanilino)xanthylbenzoic acid lactam]

(3) Leuco bases of ring-open type fluoran dyes which are represented by the following general formula:

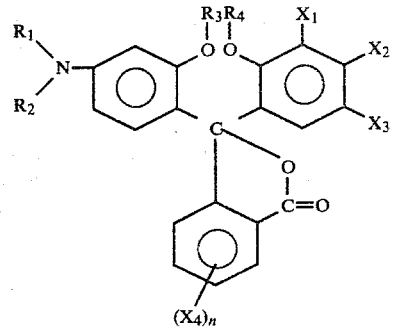

wherein $R_1$ and $R_2$ individually represents hydrogen, a lower alkyl group, a substituted or unsubstituted alkyl group, a substituted or unsubstituted phenyl group, a cyanoethyl group, a β-hydroxyethyl group, a β-halogenated ethyl group, or $R_1$ and $R_2$ in combination represent $-(CH_2)_4-$, $-(CH_2)_5-$ or $-(CH_2)_2O-(CH_2)_2-$, and $R_3$ and $R_4$ individually represents hydrogen, a lower alkyl group, an aralkyl group, an amyl group or a phenyl group and either of $R_3$ or $R_4$ is hydrogen, and $X_1$, $X_2$ and $X_3$ individually represent hydrogen, a lower alkyl group, a lower alkoxyl group, a halogen, a halogenated methyl group, a nitro group, an amino group or a substituted amino group, and $X_4$ represents hydrogen, a halogen, a lower alkyl group or a lower alkoxyl group, and n is 0 or an integer from 1 to 4.

The specific examples of the above-mentioned compounds are as follows:

3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide.

The examples of the developers which are capable of forming colors by the reaction with the above-mentioned compounds are as follows:

(1) Phenolic Compounds 3,5-xylenol, thymol, p-tert-butylphenol,
4-hydroxyphenoxide, methyl-4-hydroxybenzoate,
4-hydroxyacetophenone, α-naphthol,
β-naphthol, catechol, resorcin, hydroquinone,
4-tert-octylcatechol, 4,4'-sec-butylidenephenol,
2,2-dihydroxydiphenyl, 2,2'-methylenebis (4-methyl-6-tert-butylphenol), 2,2'-bis(4'-hydroxyphenyl)propane, 4,4'-isopropylidene-bis (2-tert-butylphenol), 4,4'-sec-butylidenediphenol, pyrogallol, phloroglucin, phloroglucinolcarboxylic acid.

(2) Acidic Materials

Boric acid, oxalic acid, maleic acid, tartaric acid, citric acid, succinic acid, benzoic acid, stearic acid, gallic acid, salicylic acid, 1-hydroxy-2-naphthoic acid, m-hydroxybenzoic acid, 2-hydroxy-p-toluic acid.

The following coloring materials can be employed for use in the high temperature thermo-sensitive coloring layer:

(1) Combinations of ferric salts of long chain fatty acids, such as ferric stearate and ferric myristate, and phenols, such as tannic acid, gallic acid and ammonium salicylate.

(2) Combinations of organic acid metallic salts, such as nickel, cobalt, lead, copper, iron, mercury salts of acetic acid, stearic acid and palmitic salt, and sulfides of alkaline earth metals, such as calcium sulfide and strontium sulfide, or combinations of the above-mentioned organic acid metallic salts and organic chelate compounds, such as S-diphenylcarbazide and diphenylcarbazone.

(3) Combinations of metallic oxalates, such as silver oxalate, lead oxalate, mercury oxalate, thorium oxalate, and sulfur compounds, such as sodium tetrathionate, sodium thiosulfate and thiourea.

(4) Combinations of ferric salts of fatty acids, such as ferric stearate, and aromatic polyhydroxy compounds, such as 3,4-dihydroxytetraphenylmethane.

(5) Combinations of organic acid metallic salts, such as silver oxalate and mercury oxalate, and organic polyhydroxy compounds, such as polyhydroxy alcohol, glycerin and glycol.

(6) Combinations of organic acid metallic salts, such as silver behenate and silver stearate, and aromatic reducing agents, such as protocatechuic acid, spiroindane and hydroquinone.

(7) Combinations of ferric salts of fatty acids, such as ferric pelargonate and ferric laurate, and derivatives of thiosemicarbamide or isothiosemicarbamide.

(8) Combinations of organic acid lead salts, such as lead caproate, lead pelargonate and lead behenate, and thiourea derivatives of ethylene thiourea and N-dodecyl thiourea.

(9) Combinations of metallic salts of higher fatty acids, such as ferric stearate and copper stearate, and lead dialkyldithiocarbamate.

(10) Combinations of compounds capable of forming dioxane dyes, such as the combinations of resorcin and nitroso compounds, or compounds capable of forming azo dyes.

For preparation of the low temperature thermo-sensitive coloring layer and the high temperature thermo-sensitive coloring layer, the following organic polymers can be employed as binder agents:

polyvinyl alcohol, methoxycellulose, hydroxyethylcellulose, carboxymethylcellulose, polyvinylpyrrolidone, polyacrylamide, polyacrylic acid, starch, gelatin, polystyrene, copolymer of vinyl chloride and vinyl acetate, polybutylmethacrylate, polyvinyl chloride, copolymer of styrene and butadiene, and rubber cloride.

In order to form the low temperature thermo-sensitive coloring layer, one part by weight of the thermo-sensitive coloring agent and 3 to 8 parts by weight of the developer are employed, and the ratio by weight of the binder agent to the total parts by weight of the thermo-sensitive coloring agent and the developer is 0.2~1.2 to 1, and the ratio of the decoloring agent to the total of the thermo-sensitive coloring agent for the formation of the low temperature thermo-sensitive coloring layer and the developer is 0.5~5.0 to 1.

Further, some known additives can be added to the low temperature and high temperature thermo-sensitive coloring layers to improve the quality of each layer.

The embodiments of the present invention will now be explained by referring to the following examples:

EXAMPLE 1

A high temperature thermo-sensitive coloring layer, a low temperature thermo-sensitive coloring layer, and a decoloring layer were prepared in accordance with the following formula:

A High Temperature Thermo-Sensitive Coloring Layer Formation Liquid

A dispersant A and a dispersant B were respectively prepared by mixing the following components in a ball mill for 10 hours, and then the dispersants A and B were sufficiently mixed to prepare the high temperature thermo-sensitive coloring layer formation liquid. Hereafter the ratio of the amount of each component is described by parts by weight:

Components of Dispersant A:
3-cyclohexylamino-6-chlorofluoran:4.7
Starch:2.0
Water:43.3
Components of Dispersant B:
Bisphenol A:19.0
Starch:2.5
Water:28.5

A Low Temperature Thermo-Sensitive Coloring Layer Formation Liquid

A dispersant C and a dispersant D were respectively prepared by mixing the following components in a ball mill for 10 hours, and then the dispersants C and D were sufficiently mixed to prepare the low temperature thermo-sensitive coloring layer formation liquid.

Components of Dispersant C:
Crystal Violet Lactone:1.8
Stearic acid amide:1.8
Hydroxyethyl cellulose:2.0
Water:44.4
Components of Dispersant D:
Bisphenol A:7.0
Oxidized starch:2.0
Water:41.0

A Decoloring Layer Formation Liquid

The following components were mixed in a ball mill for 8 hours to prepare the decoloring layer formation liquid.

Ether type glycol prepared by additive reaction of oxidized ethylene with bisphenol A (Nippon Oil & Fats Co., Ltd. Unial DA-350F):12.0
80% aqueous solution of melamine plasts (commercially available from Sumitomo Chemical Co., Ltd. under the trade name of Sumilates Resin 613):4.8
Ammonium chloride:0.2
Water:83.0

The thus prepared high temperature thermo-sensitive coloring layer liquid was coated on a high quality paper (50 g/m$^2$) using a wire bar and dried, so as to form a high temperature thermo-sensitive coloring layer with deposition of 6.2 g/m$^2$ of the thermo-sensitive coloring components on the paper. The decoloring layer formation liquid was then coated on the high temperature thermo-sensitive coloring layer and then dried. The low temperature thermo-sensitive coloring layer formation liquid was then coated with deposition of 2.1 g/m$^2$ on the decoloring layer components to form a low temperature thermo-sensitive coloring layer, whereby a multicolor thermo-sensitive recording material according to the present invention was prepared.

A reference recording material was then prepared in the same procedure as mentioned above, using polyvinyl alcohol instead of the melamine plasts when preparing the decoloring layer formation liquid.

After initiating the coating of the low temperature thermo-sensitive layers of these two recording materials, a 10 m portion and a 2000 m portion were sampled from each of the recording materials and the recording density of each low temperature thermo-sensitive layers was measured and compared with the following results:

| | Sample of the present invention | Reference sample |
|---|---|---|
| 10 m after initiation of the coating | 0.62 | 0.62 |
| 2000 m after initiation of the coating | 0.62 | 0.40 |

The above results show that the sample according to the present invention is more stable in the quality than the reference sample.

EXAMPLE 2

Another decoloring layer formation liquid was prepared by mixing the following components in a ball mill for 10 hours.

Components of the decoloring layer formation liquid:

Straight chain glycol (commercially available from Dainippon Celluloid Co., Ltd. under the trade name of AOG-X68):16.0

Methylolurethanated polyvinyl alcohol with 1% of solid component (commercially available from Mitsuitoatsu Chemicals, Inc. under the trade name of XP-66):75.0

Ammonium chloride:0.7

Water:8.3

The employed straight chain glycol, which is represented by the following formula, is a mixture of 57% of glycol containing 16 carbons in R and 43% of the glycol containing 18 carbons in R of the formula:

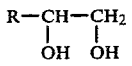

wherein R is a carbon chain with 16 carbon atoms or a carbon chain with 18 carbon atoms.

Instead of the decoloring layer formation liquid employed in Example 1, the above-mentioned decoloring layer formation liquid was employed and the same high temperature thermo-sensitive coloring layer formation liquid and low temperature thermo-sensitive coloring layer formation liquid as those employed in Example 1 were employed so that another multi-color thermo-sensitive recording material according to the present invention was prepared in the same procedure as in Example 1.

EXAMPLE 3

A further decoloring layer formation liquid was prepared using the following components in the same manner as in Example 2:

Components of the decoloring layer formation liquid:

Addition compound of oxidized ethylene (6.0 mole) and oxidized propylene (4.5 mole) of bisphenol A:14.0

Methylolpolyamide resin with 30% solid component (commercially available from Sumitomo Chemical Co., Ltd. under the trade name of Sumilates Resin 633):18.0

Ammonium chloride:0.5

Water:67.4

Instead of the decoloring layer formation liquid employed in Example 1, the above-mentioned decoloring layer formation liquid was employed and the same high temperature thermo-sensitive coloring layer formation liquid and low temperature thermo-sensitive coloring layer formation liquid as those employed in Example 1 were employed so that a further multi-color thermo-sensitive recording material was prepared in the same procedure as in Example 1.

In the recording materials of Example 2 and Example 3, after initiating the coating of the low temperature thermo-sensitive layers of these two recording materials, a 10 m portion and a 2000 m portion were sampled from each of the recording materials and the recording density of each low temperature thermo-sensitive layers was measured and compared.

The results showed that the samples of Example 2 and Example 3 were stabler in quality than the reference sample as in the case of Example 1.

Furthermore, in the present invention, the decoloring layers were prepared using the decoloring agents of the previously mentioned type and binder agents comprising water soluble organic polymers with addition of cross-linking agents thereto.

The cross-linking agents for use in the present invention are, for example, the so-called initial condensed compounds of aminoplasts (amino resin), such as melamine resin, urea resin, thiourea resin, aniline-formaldehyde resin and cyanamideformaldehyde resin; N-methylolacrylamide resin; polyamide resin having epoxy groups or methylol groups at the ends of the molecules or at the side chains thereof; hydrocarbon resin having methylol groups, such as methylolurethanated polyvinyl alcohol; and glyoxal. Also in this case, the additives for promoting cross-linking of the decoloring layer, such as ammonium nitrate, sodium nitrate, ammonium chloride and ammonium phosphate can be added to the decoloring layer.

The water soluble binder agents for use in the discoloring layer are, for example, casein, starch, denaturated starch, polyvinyl alcohol, polyvinyl acetal, polyacrylamide, polyvinyl pyrrolidone, partially saponified vinyl acetate, sodium alginate, polyacrylic acid, polyacrylate, partially esterified polyacrylic acid, carboxymethyl cellulose, methoxy cellulose, hydroxyethyl cellulose, mannan and tragacanth gum.

By containing the previously mentioned cross-linking agents in the discoloring layer, the water proofness of the decoloring layer can be improved to some extent, so that the dissolving of the decoloring layer into the low temperature thermo-sensitive coloring layer to be coated on the decoloring layer can be prevented.

By addition of 1% part or more by weight of the crosslinking agents to the water soluble organic polymer of the decoloring layer, a sufficient cross-linking result can be obtained.

EXAMPLE 4

A high temperature thermo-sensitive coloring layer, a low temperature thermo-sensitive coloring layer, and a decoloring layer were prepared in accordance with the following formula:

A High Temperature Thermo-Sensitive Coloring Layer Formation Liquid

A dispersant E and a dispersant F were respectively prepared by mixing the following components in a ball mill for 10 hours, and then the dispersants E and F were sufficiently mixed to prepare the high temperature thermo-sensitive coloring layer formation liquid. The ratio of the amount of each component is described by parts by weight.

Components of Dispersant E:
3-diethylamino-7-chlorofluoran:4.5
Starch:2.0
Water:43.5
Components of Dispersant F:
Bisphenol A:19.0
Starch:25.0
Water:28.5

A Low Temperature Thermo-Sensitive Coloring Layer Formation Liquid

A dispersant G and a dispersant H were respectively prepared by mixing the following components in a ball mill for 10 hours, and then the dispersant G and H were sufficiently mixed to prepare the low temperature thermo-sensitive coloring layer formation liquid.

Components of Dispersant G:
Crystal Violet Lactone:1.8
Stearic acid amide:2.0
Hydroxyethyl cellulose:2.0
Water:44.2
Components of Dispersant H:
Bisphenol A:7.0
Oxidized starch:2.0
Water:41.0

A Decoloring Layer Formation Liquid

The following components were mixed in a ball mill for 8 hours to prepare the decoloring layer formation liquid:

Ether type glycol prepared by additive reaction of oxidized ethylene with bisphenol A (Nippon Oils & Fats Co., Ltd. Unial DA-350F):12.0
Polyvinyl alcohol (20% aqueous solution):20.0
Water:68.0

To the thus prepared decoloring layer formation liquid was added 0.12 part by weight of methylolmelamine (initial product of melamine resin) as a cross-linking agent and 0.01 part by weight of ammonium chloride, and the mixture was mixed so that a decoloring layer formation liquid was prepared.

The previously prepared high temperature thermo-sensitive coloring layer liquid was coated on a high quality paper (50 g/m$^2$) using a wire bar and dried, so as to form a high temperature thermo-sensitive coloring layer with deposition of 5.7 g/m$^2$ of the thermo-sensitive coloring components on the paper. The decoloring layer formation liquid was then coated on the high temperature thermo-sensitive coloring layer and then dried until it became insoluble. The low temperature thermo-sensitive coloring layer formation liquid was then coated with deposition of 2.3 g/m$^2$ on the decoloring layer components to form a low temperature thermo-sensitive coloring layer, whereby a multicolor thermo-sensitive recording material was prepared.

A reference recording material was then prepared in the same procedure as mentioned above, using a decoloring layer formation liquid which did not contain such a cross-linking agent.

After initiating the coating of the low temperature thermo-sensitive layers of these two recording materials, a 10 m portion and a 2000 m portion were sampled from each of the recording materials and the recording density of each low temperature thermo-sensitive layers was measured and compared, and the following results were obtained:

| | Sample of the present invention | Reference sample |
|---|---|---|
| 10 m after initiation of the coating | 0.62 | 0.62 |
| 1000 m after initiation of the coating | 0.62 | 0.54 |
| 2000 m after initiation of the coating | 0.61 | 0.40 |

The above results show that the sample according to the present invention is stabler in the quality than the reference sample.

EXAMPLE 5

Another decoloring layer formation liquid was prepared by mixing the following components in a ball mill for 10 hours:

Components of the decoloring layer formation liquid:

| | Parts by weight |
|---|---|
| Straight chain glycol (commercially available from Dainippon Celluloid Co., Ltd. under the trade name of AOG-Y08) | 14.0 |
| Casein | 7.0 |
| Water | 79.0 |

The straight chain glycol is represented by the general formula

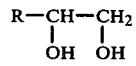

wherein R is a carbon chain containing 20, 22, 24, 26, 28 or 30 carbons. The employed straight chain glycol consists of 28% of $C_{20}$, 25% of $C_{22}$, 19% of $C_{24}$, 15% of $C_{26}$, 9% of $C_{28}$, and 4% of $C_{30}$ with respect to R.

To the thus prepared decoloring layer formation liquid was added 0.21 part by weight of glyoxal and the mixture was mixed, so that a decoloring layer formation liquid was prepared.

Instead of the decoloring layer formation liquid employed in Example 4, the above-mentioned discoloring layer formation liquid was employed and the same high temperature thermo-sensitive coloring layer formation liquid and low temperature thermo-sensitive coloring layer formation liquid as those employed in Example 4 were employed so that a multicolor thermo-sensitive recording material according to the present invention was prepared in the same procedure as in Example 4.

EXAMPLE 6

A further decoloring layer formation liquid was prepared using the following components in the same manner as in Example 5:

Components of the decoloring layer formation liquid:

| | Parts by weight |
|---|---|
| Ether type glycol prepared by additive reaction of oxidized ethylene with bisphenol A (Nippon Oils & Fats Co., Ltd. Unial DA-350F) | 12.0 |
| Polyvinyl acetal | 6.0 |
| Water | 82.0 |

To the thus prepared decoloring layer formation liquid was added 0.15 part by weight of melamine resin (commerciably available from Sumitomo Chemical Co., Ltd. under the trade name of Sumitex M-3) as a cross-linking agent and the mixture was mixed, so that a decoloring layer formation liquid was prepared.

Instead of the decoloring layer formation liquid employed in Example 4, the above-mentioned decoloring layer formation liquid was employed and the same high temperature thermo-sensitive coloring layer formation liquid and low temperature thermo-sensitive coloring layer formation liquid as those employed in Example 4 were employed so that a further multi-color thermo-sensitive recording material was prepared in the same procedure as in Example 4.

In the recording materials of Example 5 and Example 6, after initiating the coating of the low temperature thermo-sensitive layers of these two recording materials, a 10 m portion, a 1000 m portion and a 2000 m portion with B-5 size were sampled from each of the recording materials and the recording density of each low temperature thermo-sensitive layers was measured and compared.

The results showed that the samples of Example 5 and Example 6 were more stabler in quality than the reference sample as in the case of Example 4.

What is claimed is:

1. In a multi-color thermo-sensitive recording material comprising a support material carrying, in the following order, a lower thermo-sensitive coloring layer, a decoloring layer and an upper thermo-sensitive coloring layer, said lower thermo-sensitive coloring layer being capable of forming a first color at a first temperature, said upper thermo-sensitive coloring layer being capable of forming a second color at a second temperature which is lower than said first temperature, said second color being different from said first color, and said decoloring layer is capable of decoloring said upper thermo-sensitive coloring layer in such a manner that the color of said upper thermo-sensitive coloring layer does not overlap the color of said lower thermo-sensitive coloring layer, the improvement which comprises:

(i) said upper thermo-sensitive coloring layer comprises a colorless or light-colored leuco dye color former, an acidic color developer and a binder material;

(ii) said decoloring layer comprises a decoloring agent capable of decoloring said upper thermo-sensitive coloring layer when said upper thermo-sensitive layer is heated to said first temperature, and a cross-linking type resin which is cross-linked in the course of the coating of said layers;

(iii) said lower thermo-sensitive coloring layer contains a color former and a color developer, which form a color different from the color formed by said upper thermo-sensitive coloring layer.

2. A multi-color thermo-sensitive recording material as claimed in claim 1, wherein said cross-linking type resin comprises an organic polymeric binder material and a cross-linking agent capable of cross-linking said organic polymeric binder material in the course of coating said two thermo-sensitive coloring layers.

3. A multi-color thermo-sensitive recording material as claimed in claim 2, wherein said organic polymeric binder material is selected from the group consisting of casein, starch, denaturated starch, polyvinyl alcohol, polyvinyl acetal, polyacrylamide, polyvinyl pyrrolidone, partially saponified vinyl acetate, sodium alginate, polyacrylic acid, polyacrylate, partially esterified polyacrylic acid, carboxymethyl cellulose, methoxy cellulose, hydroxyethyl cellulose, mannan and tragacanth gum; and said cross-linking agent is selected from the group consisting of initial condensed compounds of aminoplasts including melamine resin, urea resin, thiourea resin, aniline-formaldehyde resin and cyanamide-formaldehyde resin; N-methylolacrylamide resin; polyamide resin having epoxy groups or methylol groups at the ends of the molecules or at the side chains thereof; hydrocarbon resin having methylol groups including methylolurethanated polyvinyl alcohol; and glyoxal.

4. A multi-color thermo-sensitive recording material as claimed in claim 1, wherein said acidic color developer is a phenolic material.

5. A multi-color thermo-sensitive recording material as claimed in claim 1, wherein said cross-linking type resin is a self cross-linking type water-soluble resin.

6. A multi-color thermo-sensitive recording material as claimed in claim 4, wherein said self cross-linking type water soluble resin is selected from the group consisting of initial condensed compounds of aminoplasts, methylolurethanated polyvinyl alcohol, polyamides having epoxy groups or methylol groups at the ends of the molecules or at the side chains, and hydrocarbons resins having methylol groups at the ends of the molecules or at the side chains.

7. A multi-color thermo-sensitive recording material as claimed in claim 1, wherein, in said upper thermo-sensitive coloring layer, the weight ratio of said color former to said color developer is 1:3 to 1:8, the weight ratio of said binder material to the sum of said color former and said color developer is 0.2:1 to 1.2:1, and the weight ratio of said decoloring agent to the sum of said color former and said color developer is 0.5:1 to 5:1.

8. In a two color, thermo-sensitive, recording material, comprising: a support, a lower thermo-sensitive coloring layer coated on said support, an intermediate layer coated on said lower thermo-sensitive coloring layer and an upper thermo-sensitive coloring layer coated on said intermediate layer, said lower thermo-sensitive coloring layer containing a color former and a color developer capable of reacting at a first temperature to form a first color, said upper thermo-sensitive coloring layer containing a colorless or light-colored leuco dye color former and an acidic color developer, said leuco dye color former and said acidic color developer being capable of reacting at a second temperature which is lower than said first temperature, to form a second color which is different from said first color, said intermediate layer containing a material capable of decoloring in said upper thermo-sensitive layer when said upper thermo-sensitive layer is heated to said first temperature, the improvement which comprises: said intermediate layer also contains a cross-linked, water-insoluble resin effective to prevent said intermediate layer from being substantially dissolved in said upper thermo-sensitive layer during the coating of said upper thermo-sensitive layer on said intermediate layer whereby to prevent contamination of said upper thermo-sensitive layer by said intermediate layer.

9. A method for preparing a two color, thermo-sensitive, recording material, comprising a support, a lower thermo-sensitive coloring layer coated on said support, an intermediate layer coated on said lower thermo-sensitive coloring layer and an upper thermo-sensitive coloring layer coated on said intermediate layer, said lower thermo-sensitive coloring layer containing a color former and a color developer capable of reacting at a first temperature to form a first color, said upper thermo-sensitive coloring layer containing a colorless or light-colored leuco dye color former and an acidic color developer, said leuco dye color former and said acidic color developer being capable of reacting at a second temperature which is lower than said first temperature, to form a second color which is different from said first color, said intermediate layer containing a material capable of decoloring in said upper thermo-sensitive layer when said upper thermo-sensitive layer is heated to said first temperature.

comprising the steps of: coating on said support a first layer of a first aqueous liquid composition containing said color former and said color developer and then drying said first layer to form said lower thermo-sensitive coating layer; then coating on said lower thermo-sensitive layer a second layer of a second aqueous composition containing said material and a water-soluble cross-linkable resin capable of being cross-linked to form a water-insoluble resin and then drying said second layer to form said intermediate layer and effecting cross-linking of said resin to form a cross-linked water-insoluble resin in said intermediate layer; and then coating on said intermediate layer a third layer of a third aqueous composition containing said leuco dye color former and acidic color developer and then drying said third layer to form said upper thermo-sensitive layer, said cross-linked water-insoluble resin being effective to prevent dissolving of said intermediate layer in said third aqueous composition.

* * * * *

UNITED STATES PATENT AND TRADEMARK OFFICE

CERTIFICATE OF CORRECTION

PATENT NO. : 4 311 750

DATED : January 19, 1982

INVENTOR(S) : Keishi Kubo and Tetsuo Tanaka

It is certified that error appears in the above—identified patent and that said Letters Patent is hereby corrected as shown below:

Column 14, line 39; change "claim 4" to ---claim 5---.

Column 15, line 3; delete "in".

Column 16, line 3; delete "in".

Signed and Sealed this

*Sixth* Day of *April 1982*

[SEAL]

*Attest:*

GERALD J. MOSSINGHOFF

*Attesting Officer*

*Commissioner of Patents and Trademarks*